US006811281B1

(12) United States Patent
Hsiao

(10) Patent No.: US 6,811,281 B1
(45) Date of Patent: Nov. 2, 2004

(54) NIGHT LIGHT IN COMBINATION WITH A PATTERNED BOARD

(76) Inventor: Feng-Shen Hsiao, 10th Fl., No. 5, Sec. 1, Tun Hua S. Rd., Taipei (TW)

( * ) Notice: Subject to any disclaimer, the term of this patent is extended or adjusted under 35 U.S.C. 154(b) by 1 day.

(21) Appl. No.: 10/428,820

(22) Filed: May 5, 2003

(51) Int. Cl.[7] ..... H01R 33/00; H01R 27/02; G09F 13/04

(52) U.S. Cl. ..... 362/226; 362/401; 362/812; 40/716; 439/652

(58) Field of Search ..... 362/95, 226, 253, 362/401, 806, 812; 40/716, 761, 762, 765, 766; 439/490, 652

(56) References Cited

U.S. PATENT DOCUMENTS 3,061,716 A * 10/1962 Benander ..... 362/226
4,000,405 A * 12/1976 Horwinski ..... 362/95
4,549,250 A * 10/1985 Spector ..... 362/226
4,714,984 A * 12/1987 Spector ..... 362/226
5,622,424 A * 4/1997 Brady ..... 362/226
6,676,274 B1 * 1/2004 Rafferty ..... 362/226

* cited by examiner

*Primary Examiner*—Alan Cariaso
(74) *Attorney, Agent, or Firm*—Rosenberg, Klein & Lee

(57) ABSTRACT

A board is made of translucent material and has two connecting plates formed on a side face of the board and a pattern formed on the board. A night light has five pairs of sockets adapted to connect to five plugs, two ears formed on opposite side faces of the night light to correspond to the connecting plates, a set of connecting pins formed on a rear side face of the night light to adapt for connecting to a wall outlet and a bulb received inside the night light. When the night light is connected to the wall outlet via the set of connecting pins, the bulb is lit to present the pattern of the board through the translucent board.

3 Claims, 5 Drawing Sheets

NIGHT LIGHT IN COMBINATION WITH A PATTERNED BOARD

BACKGROUND OF THE INVENTION

1. Field of the Invention

The present invention relates to a night light and a patterned board, and more particularly to a night light detachably connected to a translucent patterned board such that when the night light is lit, the pattern on the board is presented to increase the surrounding environment.

2. Description of Related Art

During the night, in order to avoid collision, the household normally will keep a night light on so that no-one in the house will collide with something in the dark. Browsing the existing night lights, function-orientated night lights, such as the scented night lights, peculiar shaped night lights etc. are becoming more and more popular. As the different functions of the night lights become diversified, prices of these night lights are becoming higher and higher so that users will not go after these high-priced night lights and go for the night lights with single function. However, even when buying these low-priced and single function night lights, users would want to have something different from the conventional night lights so as to increase the decoration effect.

The currently available night light normally is equipped with a casing shaped into a variety of forms so that when the bulb in the night light is lit, the shape of the casing is projected and entertainment of the surrounding environment is increased. However, projecting shapes is dull and unfulfilling.

The present invention tends to provide an improved night light in combination with a patterned board to obviate the aforementioned problems.

SUMMARY OF THE INVENTION

The primary objective of the present invention is to provide an improved night light in combination with a patterned board detachably connected to the night light so that the pattern on the board is presented when the night light is lit.

Another objective of the present invention is to provide a translucent board such that when the night light is lit, the pattern is clearly seen from a side opposite to the night light.

Other objects, advantages and novel features of the invention will become more apparent from the following detailed description when taken in conjunction with the accompanying drawings.

DETAILED DESCRIPTION OF THE PREFERRED EMBODIMENT

Figure 1:
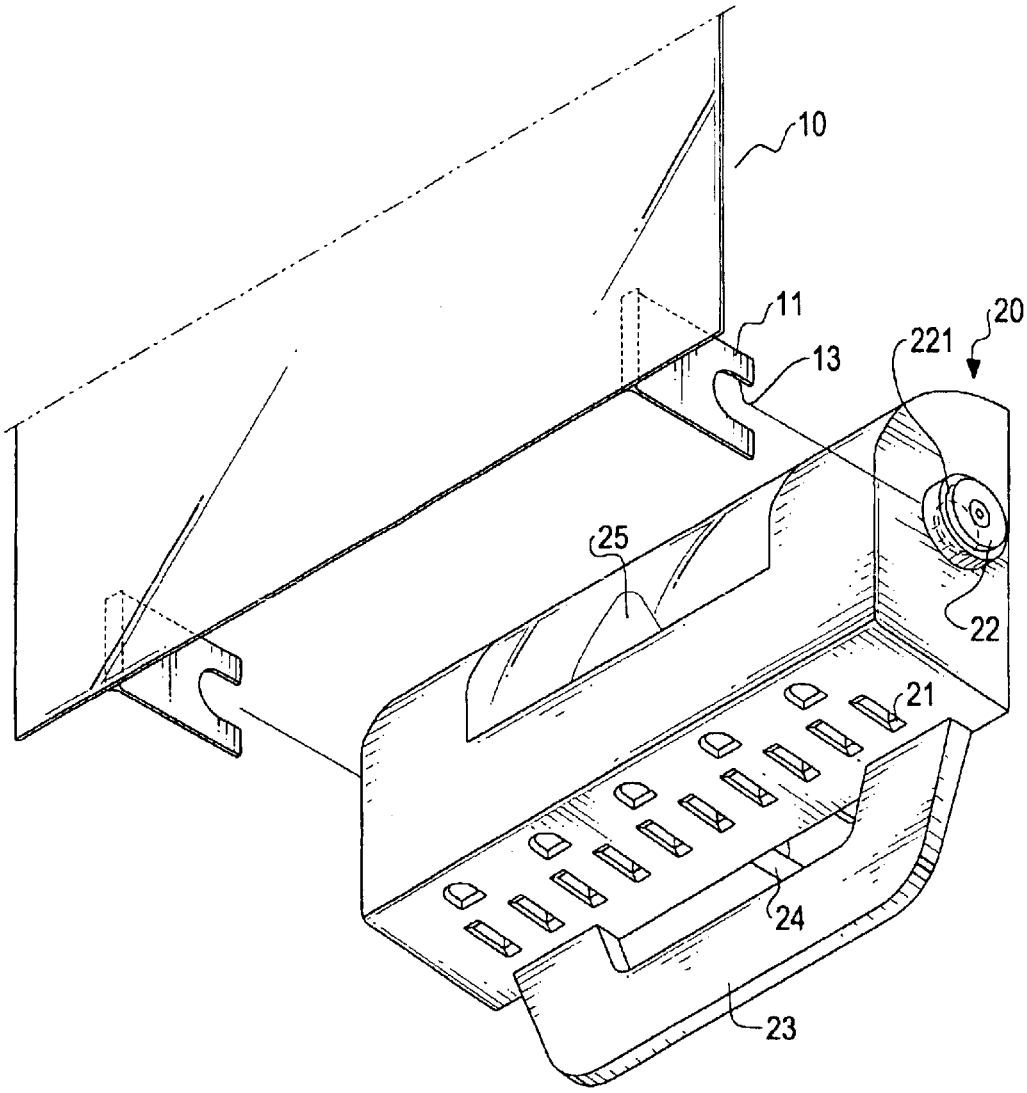
FIG. 1 is an exploded perspective view of the present invention.

With reference to FIG. 1, the present invention includes a board (10) and a night light (20).

The board (10) has two connecting plates (11) formed on a side face of the board (10). Each connecting plate (11) has an arcuate notch (13).

The night light (20) is a conventional night light with five pairs of sockets (21) for connecting to five plugs (not shown), two ears (22) formed on opposite side faces of the night light (20) to correspond to the connecting plates (11), a weight (23) formed on a bottom side face of the night light and extending in a direction opposite to the board (10) and a set of connecting pins (24) formed on a rear side face of the night light (20) for connecting to a wall outlet (not shown). A bulb (25) is received inside the night light (20) so that when the night light (20) is connected to the wall outlet via the set of connecting pins (24), the bulb (25) is lit. Further, each of the ears (22) is annular and has a step (221) formed on the ear (22) to correspond to the arcuate notch (13).

Figure 2:
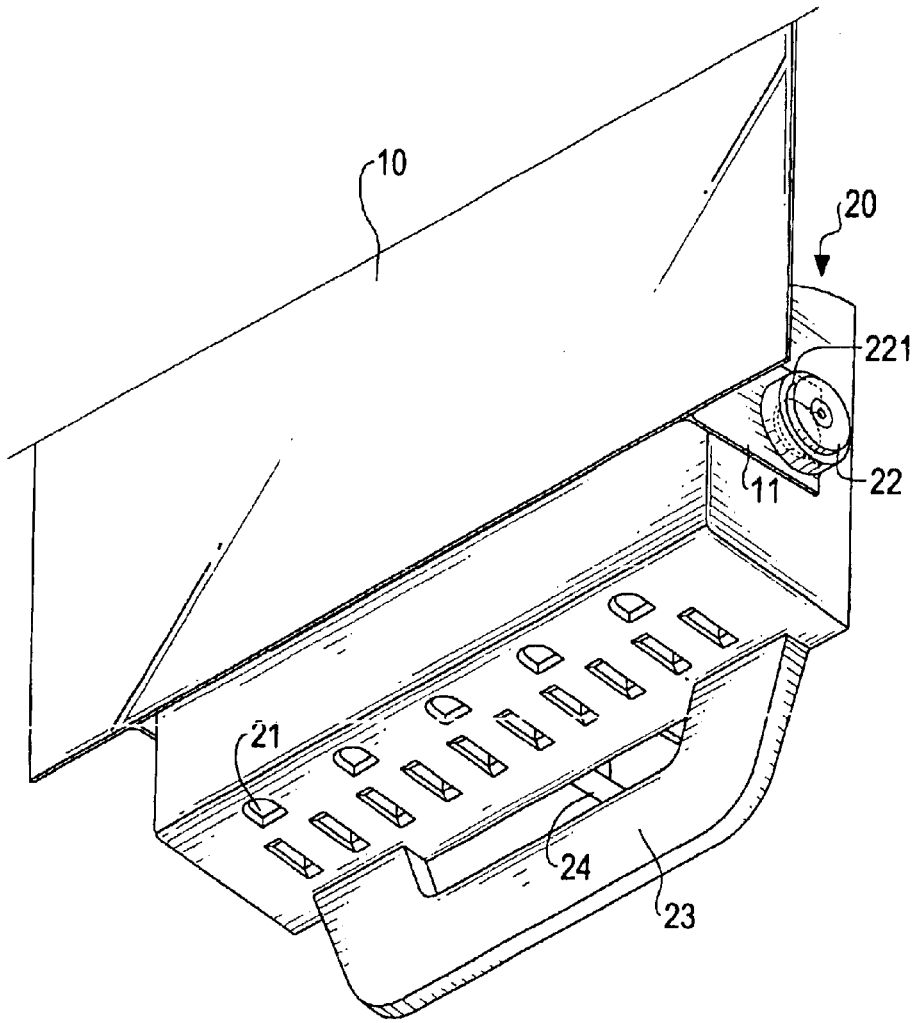
FIG. 2 is a perspective view of the present invention in assembly.

With reference to FIG. 2, when the present invention is in assembly, the connecting plates are connected to the two ears (22) via the matching between two arcuate notches (13) and the steps (221). That is, the connecting plates (11) clamp the two ears (22) respectively. After the assembly of the board (10) and the night light (20), the bulb (25) in FIG. 1 is concealed behind the board (10).

Figure 3:
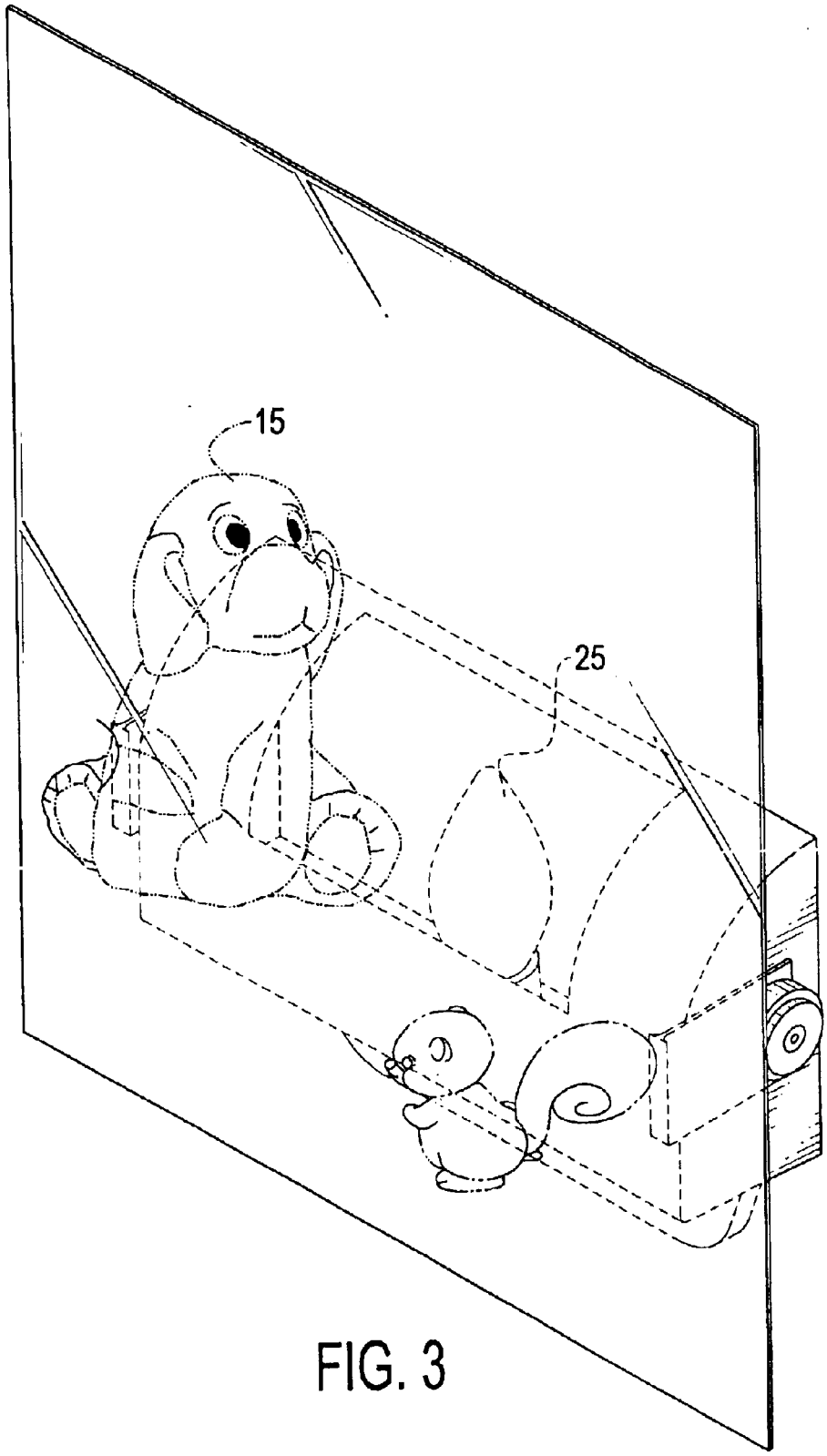
FIG. 3 is a perspective view showing that the board is made of translucent material so that a pattern on the board is barely visible when the bulb in the night light is not lit.
Figure 4:
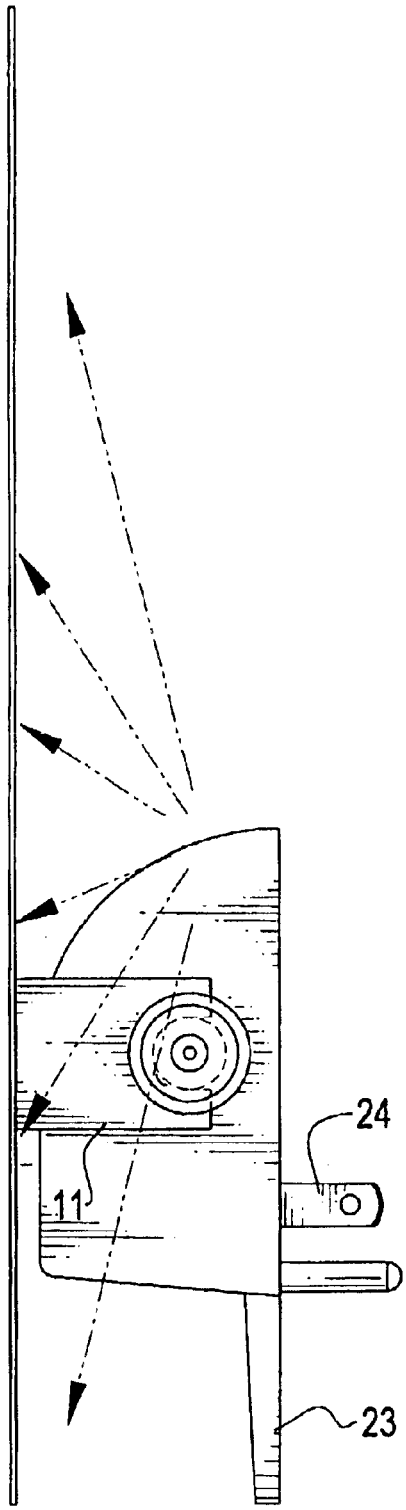
FIG. 4 is a schematic side view showing a bulb in the night light is lit.
Figure 5:
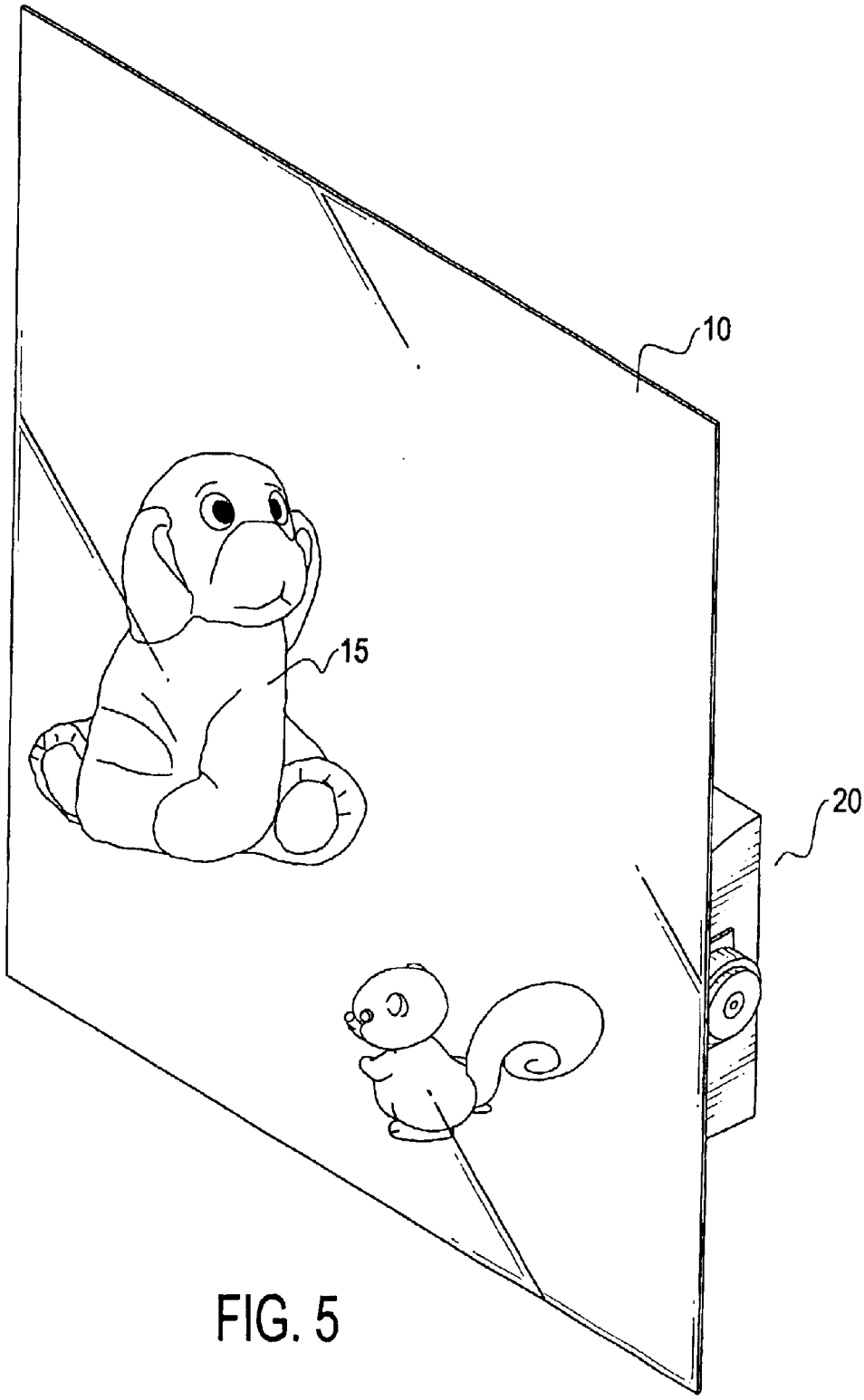
FIG. 5 is a perspective view showing that after the bulb in the night light is lit, the pattern on the board is clearly visible from a side of the board opposite to the night light.

With reference to FIGS. 3 and 4, it is noted that the board (10) is made of translucent material and has a pattern (15) formed on the board (10) so that when the bulb (25) is not lit, the pattern is barely seen. However, when the bulb (25) is lit as indicated by the arrows in FIG. 4, the pattern (15) is clearly visible by an observer, as shown in FIG. 5, which increases the fulfillment and decorative effect to the surrounding environment. For stability of the night light, the weight (23) formed on a bottom side face of the night light extends in a direction opposite to the board (10) to balance a weight of the board (10) relative to the night light (20).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A night light in combination with a patterned board, wherein the board is made of translucent material and has two connecting plates formed on a side face of the board and a pattern formed on the board, each connecting plate having an arcuate notch;

the night light has at least one pair of sockets adapted to connect to a corresponding quantity of plugs, two ears formed on opposite side faces of the night light to correspond to the connecting plates, a weight formed on a bottom side face of the night light and extending in a direction opposite to the board to balance a weight of the board relative to the night light, a set of connecting pins formed on a rear side face of the night light to adapt for connecting to a wall outlet and a bulb received inside the night light, whereby when the night light is connected to the wall outlet via the set of connecting pins, the bulb is lit to present the pattern of the board through the translucent board.

2. The night light in combination with a patterned board as claimed in claim 1, wherein each of the ears is annular and has a step formed on the ear to correspond to the arcuate notch so that the connecting plates are able to detachably connect to the ears.

3. The night light in combination with a patterned board as claimed in claim 2, wherein five pairs of sockets are provided to the night light.

* * * * *